US010808636B2

(12) United States Patent
Stowasser et al.

(10) Patent No.: US 10,808,636 B2
(45) Date of Patent: Oct. 20, 2020

(54) METHOD FOR CONTROLLING AN INTERNAL COMBUSTION ENGINE HAVING A CAMSHAFT

(71) Applicant: Continental Automotive GmbH, Hannover (DE)

(72) Inventors: Wolfgang Stowasser, Regensburg (DE); Suk-Ju Kim, Regensburg (DE)

(73) Assignee: VITESCO TECHNOLOGIES GMBH, Hannover, MI (US)

( * ) Notice: Subject to any disclaimer, the term of this patent is extended or adjusted under 35 U.S.C. 154(b) by 170 days.

(21) Appl. No.: 15/766,158

(22) PCT Filed: Sep. 20, 2016

(86) PCT No.: PCT/EP2016/072299
§ 371 (c)(1),
(2) Date: Apr. 5, 2018

(87) PCT Pub. No.: WO2017/060075
PCT Pub. Date: Apr. 13, 2017

(65) Prior Publication Data

US 2018/0298836 A1 Oct. 18, 2018

(30) Foreign Application Priority Data

Oct. 7, 2015 (DE) ..... 10 2015 219 335

(51) Int. Cl.
*F01L 1/34* (2006.01)
*F02D 41/04* (2006.01)
(Continued)

(52) U.S. Cl.
CPC ..... *F02D 41/042* (2013.01); *F01L 1/344* (2013.01); *F02D 41/062* (2013.01);
(Continued)

(58) Field of Classification Search
CPC .... F02D 41/042; F02D 41/062; F02D 41/064; F02D 41/065; F02D 2041/001;
(Continued)

(56) References Cited

U.S. PATENT DOCUMENTS 8,335,628 B2 12/2012 Yoo
2006/0042578 A1 3/2006 Izumi et al.
(Continued)

FOREIGN PATENT DOCUMENTS

DE 102005022714 A1 11/2006
DE 102006017232 A1 10/2007
(Continued)

OTHER PUBLICATIONS

International Search Report and Written Opinion dated Dec. 20, 2016 from corresponding International Patent Application No. PCT/EP2016/072299.
(Continued)

*Primary Examiner* — Zelalem Eshete

(57) ABSTRACT

A method according to the invention for controlling an internal combustion engine having a camshaft whose phase with respect to a crankshaft can be adjusted by means of an electric adjustment device, and a control device comprises the steps S1 to S3, wherein in step S1 a stop request is output from the control device to the electric adjustment device. Subsequently, in step S2 a manipulated variable in the form of a pulse duty factor is output from the electric adjustment device, wherein the pulse duty factor counteracts a camshaft torque. In step S3, the direction of rotation of the camshaft is monitored, wherein in step S4, when a reversal of the direction of rotation of the camshaft is detected, an intensity level of this reversal of the direction of rotation is calculated by determining a rotational speed gradient. Furthermore, in a step S5 the pulse duty factor is corrected as a function of
(Continued)

the rotational speed gradient in such a way that the influence of the reversal of the direction of rotation on the position of the camshaft is compensated.

18 Claims, 2 Drawing Sheets

(51) Int. Cl.
*F02D 41/06* (2006.01)
*F01L 1/344* (2006.01)
*F02D 41/00* (2006.01)

(52) U.S. Cl.
CPC ..... *F02D 41/064* (2013.01); *F02D 41/065* (2013.01); *F01L 2201/00* (2013.01); *F01L 2800/01* (2013.01); *F01L 2800/02* (2013.01); *F01L 2800/03* (2013.01); *F01L 2820/032* (2013.01); *F02D 2041/001* (2013.01); *F02D 2250/06* (2013.01)

(58) Field of Classification Search
CPC . F02D 2250/06; F01L 1/344; F01L 2820/032; F01L 2800/02; F01L 2800/01; F01L 2800/03; F01L 2201/00
See application file for complete search history.

(56) References Cited

U.S. PATENT DOCUMENTS

2010/0145592 A1* 6/2010 Yoo ..... F01L 1/022 701/102
2013/0080027 A1* 3/2013 Mikawa ..... F02D 13/0238 701/102

FOREIGN PATENT DOCUMENTS

| | | | |
|---|---|---|---|
| DE | 102006061104 | A1 | 6/2008 |
| DE | 102008032026 | A1 | 1/2010 |
| DE | 102012018806 | A1 | 3/2013 |
| DE | 102012216890 | A1 | 3/2013 |
| DE | 102012216934 | A1 | 4/2013 |
| KR | 20130034612 | A | 4/2013 |

OTHER PUBLICATIONS

Office Action dated Apr. 25, 2016 from corresponding German Patent Application No. 10 2015 219 335.7.
Korean Office Action dated Feb. 22, 2019 for corresponding Korean Patent Application No. 10-2018-7011679.

* cited by examiner

METHOD FOR CONTROLLING AN INTERNAL COMBUSTION ENGINE HAVING A CAMSHAFT

BACKGROUND

The invention relates to method for controlling an internal combustion engine and to a camshaft adjustment device for an internal combustion engine, and to a motor vehicle having a camshaft adjustment device.

The starting period of an internal combustion engine can be composed of a time component for the synchronization of a control unit and the actual starting process during which ignition processes of the fuel-air mixture occur. For starting it may be necessary for the crankshaft of the internal combustion engine to be synchronised with the camshaft of the internal combustion engine. The profile of a combustion process in an internal combustion engine can be influenced by the synchronization. It is therefore possible to bring about predefined opening and closing of the valves by means of the synchronization. As a result, the starting process can be influenced with respect to, for example, emissions, consumption and the load. The synchronization can take place by means of a control unit. A synchronization process between the crankshaft and the camshaft is effected by means of a control chain, a control belt or a gear wheel pairing. As result of this essentially rigid coupling there is a fixed phase relationship between the rotation of the camshaft and the rotation of the crankshaft.

It has, however, become apparent that it may be advantageous for the operation of an internal combustion engine, in particular with respect to the fuel consumption and the increase in the power, to set this fixed phase relationship between the camshaft and the crankshaft while the internal combustion engine is operating. It is possible to set the phase relationship between the camshaft and the crankshaft as necessary by means of hydraulic or electric camshaft adjustment devices. An electric-motor-operated camshaft adjustment device is composed of an adjustment mechanism which is connected in a rotationally fixed fashion to the camshaft and an electric-motor-operated adjustment drive which is attached to the internal combustion engine and whose motor shaft acts on the adjustment shaft of the adjustment mechanism which rotates at the rotational speed of the camshaft.

From the prior art it is known that the phase angle of the camshaft relative to a crankshaft is determined by means of an encoder wheel which is attached to the camshaft. On this encoder wheel there are teeth which are sensed e.g. by a Hall sensor when the camshaft rotates. Whenever, for example, a start of a tooth is detected, a phase edge interrupt is triggered in an engine controller. As a rule, encoder wheels with four teeth, which have different lengths, are used on the camshaft. This specific profile serves to permit more rapid synchronization between the camshaft and crankshaft and therefore allows the internal combustion engine to start more quickly. The speed of the camshaft is as a rule determined between two phase edge interrupts, wherein the camshaft position is extrapolated linearly until the next phase edge interrupt is reached. Particularly in the case of a reversal of the direction of rotation of the phase angle between the camshaft and the crankshaft, faulty camshaft positions can occur, which entails corresponding disadvantages for the starting process of the internal combustion engine. A reduction in these deviations can lead to a reduction in pollutant emissions and consumption of fuel, can increase engine power and the torque and can decrease the loading on the on-board electrical system when the engine starts, and can reduce the rotational speed of the engine in the low idling mode. It is particularly important to maintain the optimum adjustment angle when the engine starts, in order to lower the high pollutant raw emissions in this operating state.

Electric-motor-operated camshaft adjustment devices are distinguished by rapid and precise camshaft adjustment in the entire operating range of the internal combustion engine. This also applies to cold starting and restarting after the internal combustion engine has stalled. It proves disadvantageous here that the shut-off process of an internal combustion engine can be subject to large degrees of fluctuation. This can mean that the precise position of the piston and therefore the angle of the crankshaft that is connected to the piston can possibly not be predicted. Therefore, the crankshaft can, for example, even be turned back in the last section of the shut-down process. That is to say in the last section of the shut-down process the rotation of the crankshaft can take place in a direction which is opposed to the direction which is customary when the engine is operating. Renewed synchronization is unavoidable. A type of synchronization can be achieved by moving the adjuster to the mechanical end stop. The camshaft position for an ideal cold start usually does not correspond to one of the mechanical end stops but instead lies within the adjustment range. If the camshaft position differs from the ideal starting position, the starting process can become longer. A typical starting process in contemporary internal combustion engines lasts approximately one second. It is a general aim of automobile manufacturers to shorten this time as far as possible, since it is felt to be disruptive e.g. for NVH reasons (noise, vibration, harshness).

In addition, systems with shortened starting times experience increased market acceptance. Final customers expect, for example when starting a traffic light, even with a so-called stop-start system, a similar degree of agility to that which they are accustomed to from conventional motor vehicles, without shutting down the engine during the red phase of the traffic lights.

The present invention is based on the object of disclosing a method which permits the starting process, in particular the cold starting process, of an internal combustion engine to be improved in a simple and reliable way to the effect that the duration of the starting process is shortened and non-starting processes are largely avoided.

BRIEF SUMMARY

The invention achieves this object by means of a method, a device and a motor vehicle having the features of the independent claims. Subclaims present preferred embodiments.

According to a first aspect of the invention, a method for controlling an internal combustion engine having a camshaft whose phase with respect to a crankshaft can be adjusted by means of an electric adjustment device, and a control device are indicated, wherein the method has the steps S1 to S5. In step S1 a stop request is output from the control device to the electric adjustment device. In step S2 a manipulated variable in the form of a pulse duty factor is output from the electric adjustment device, wherein the pulse duty factor counteracts a camshaft torque. Subsequently, in step 3, the direction of rotation of the camshaft is monitored, wherein in step S4, when a reversal of the direction of rotation of the camshaft is detected, an intensity level of this reversal of the direction of rotation is calculated by determining a rotational speed gradient. Furthermore, in a step S5 the pulse duty factor is corrected as a function of the rotational speed gradient in such a way that the influence of the reversal of the direction of rotation on the position of the camshaft is compensated.

In this way, the phase angle of the camshaft can already be positioned in an ideal fashion when the engine is shut down and therefore before the following engine start. The starting process is significantly shortened because the time period for the initialization of the electromechanical phase adjuster and the otherwise customary phase adjustment during or after the engine starting process is eliminated. Therefore, the compression and the degree of filling of the individual cylinders can be selectively influenced by means of the opening and closing times, and the exhaust gas emissions during the starting of the engine can be reduced. Particularly direct starting systems, rapid starting systems or stop-start systems are particularly favored by the method according to the invention.

The detection of the reversal of the direction of rotation takes place advantageously by means of a sensor. In another variant or in addition to the sensor, the detection of the reversal of the direction of rotation can also take place by means of a functional solution in the control device.

In one particularly preferred embodiment, the outputting of a correction signal can be carried out by the control device.

It has proven particularly advantageous that the internal combustion engine comprises a camshaft sensor which is connected to the control device, wherein the camshaft sensor transmits a phase edge interrupt of a crankshaft encoder wheel as a signal with high chronological resolution to the control device, wherein the control device preferably carries out the determination of the rotational speed gradient on the basis of this signal with high chronological resolution.

In one particularly preferred embodiment, the influence of the reversal of the direction of rotation on the pulse duty factor is stored as a function of the rotational speed gradient as a characteristic diagram in the control device, wherein the values of the characteristic diagram are added to the pulse duty factor during the compensation of the reversal of the direction of rotation.

It has proven particularly advantageous that the camshaft sensor is integrated into the sensor for detecting the reversal of the direction of rotation, or vice versa.

The detection of the reversal of the direction of rotation is advantageously carried out by the control device.

The method according the invention can be implemented in a camshaft adjustment device for an internal combustion engine. Accordingly, a camshaft adjustment device having a camshaft and a crankshaft also forms a further subject matter of the invention, wherein the camshaft adjustment device comprises a control device and at least one sensor, wherein the sensor is configured to provide the control device with information about the direction of rotation of the camshaft, and wherein the control device is configured to carry out the method described above.

It has proven particularly advantageous that the camshaft adjustment device comprises a camshaft sensor which is connected to the control device, wherein the camshaft sensor transmits a phase edge interrupt of a crankshaft encoder wheel as a signal with high chronological resolution to the control device, wherein detection of the reversal of the direction of rotation takes place by means of a sensor and/or by means of a functional solution in the control device, and the camshaft sensor is preferably integrated into the sensor for detecting the reversal of the direction of rotation, or vice versa.

The method according to the invention can be provided in a motor vehicle. Accordingly, a motor vehicle having an internal combustion engine which is equipped with a control device and a camshaft adjustment device also forms a further subject matter of the invention, wherein the motor vehicle has a control device for carrying out the method described above.

Further features, application possibilities and advantages of the invention can be found in the following description of the exemplary embodiment of the invention which is illustrated in the figures. It is to be noted here that the illustrated features are merely of a descriptive nature and may also be used in combination with features of other developments described above and are not intended to restrict the invention in any form.

BRIEF DESCRIPTION OF THE DRAWINGS

The invention will now be described more precisely with respect to the appended figures. In the drawings, in each case in schematic form.

DETAILED DESCRIPTION

Figure 1:
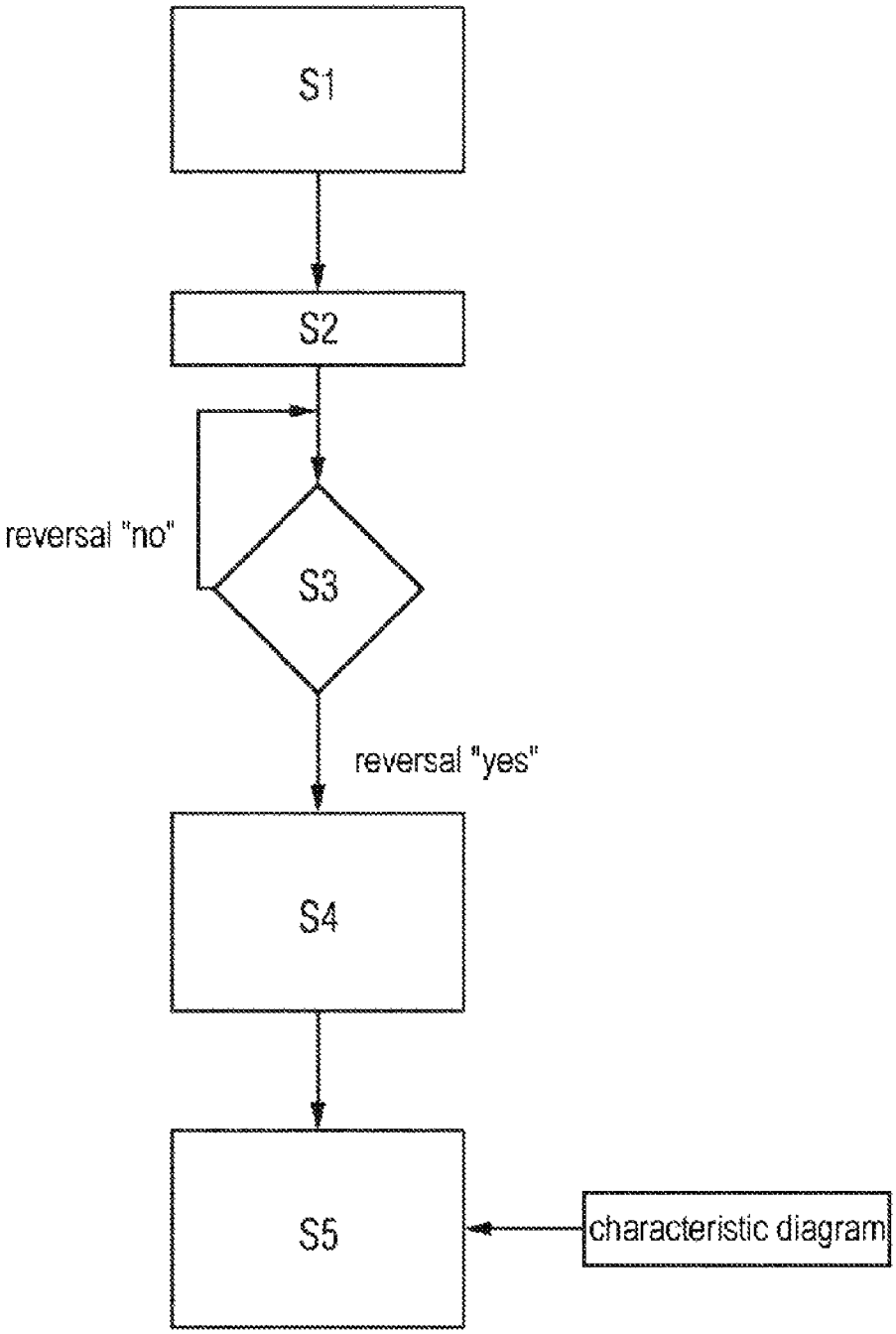
FIG. 1 shows a method according to the invention for controlling an internal combustion engine having a camshaft.
Figure 2:
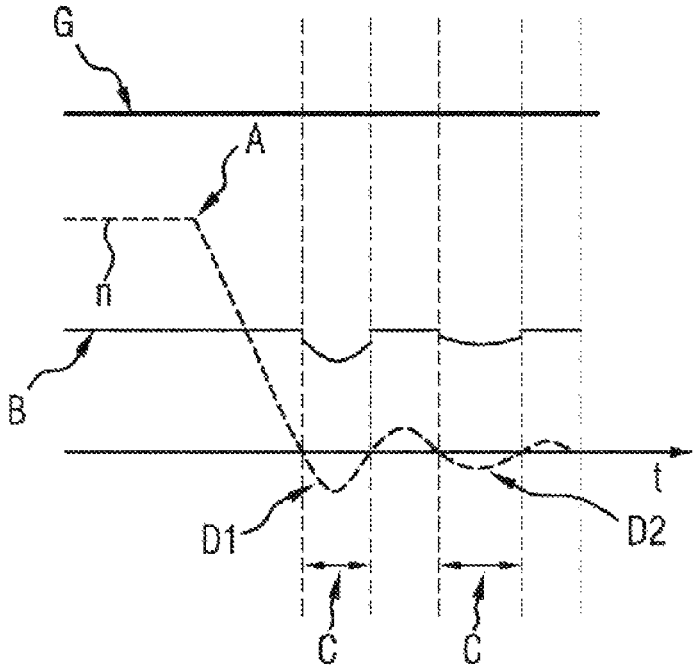
FIG. 2 shows a graphic illustration of a camshaft position profile as a function of the time (continuous line) after the outputting of a stop request with compensation according to a method according to the invention.
Figure 3:
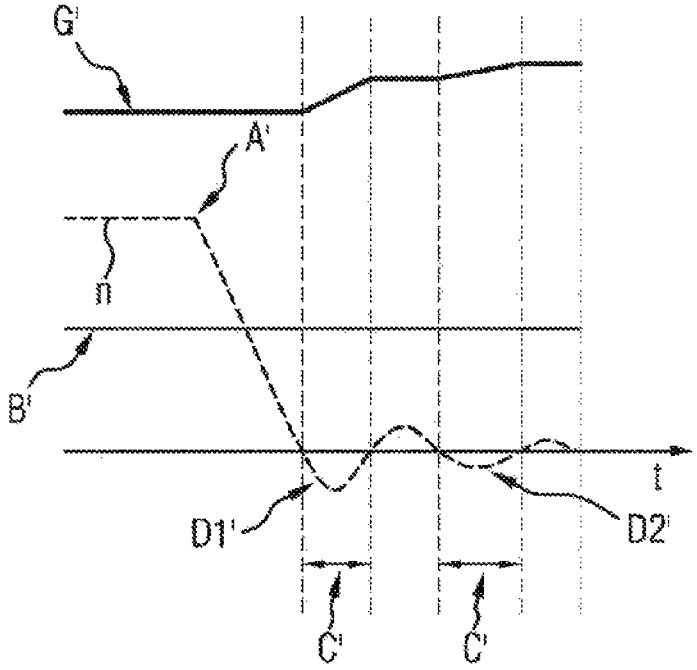
FIG. 3 shows a graphic illustration of a camshaft position profile as a function of the time (continuous line) after the outputting of a stop request without compensation according to the prior art.

FIG. 1 shows a method according to the invention for controlling an internal combustion engine with a camshaft and a control device, wherein the phase of the camshaft, in FIG. 2 denoted as G and in FIG. 3 as G', can be adjusted with respect to a crankshaft by means of an electric adjustment device. The method is started in step S1, wherein a stop request denoted in FIG. 2 as A and in FIG. 3 as A', is output to the electric adjustment device by a control device, with the result that the rotational speed of the internal combustion engine is greatly reduced. In step S2, a manipulated variable in the form of a pulse duty factor, denoted in FIG. 2 as B and in FIG. 3 as B', is output by the electric adjustment device, wherein the pulse duty factor counteracts a camshaft torque. Subsequently, in step S3 the direction of rotation of the camshaft is monitored. The detection of the reversal of the direction of rotation usually takes place by means of a sensor but can also additionally or alternatively take place by means of a functional solution in the control device.

If no reversal C of the direction of rotation takes place, monitoring is carried out in step S3 until the internal combustion engine has come to a standstill and the camshaft G is in an ideal starting position, or until a reversal C of the direction of rotation is detected, denoted in FIG. 2 as C and in FIG. 3 as C'. It is conceivable here that the camshaft sensor is integrated into the sensor for detecting the reversal of the direction of rotation, or vice versa, wherein the detection of the reversal C of the direction of rotation takes place by means of the control device.

When a reversal C of the direction of rotation of the camshaft G is detected, in the subsequent step S4 an intensity level is calculated, denoted in FIG. 2 as D1, D2 and in FIG. 3 as D1', D2', of this reversal C of the direction of rotation by determining a rotational speed gradient F, wherein a correction signal is output by the control device.

The internal combustion engine preferably comprises a camshaft sensor which is connected to the control device, wherein the camshaft sensor furthermore transmits a phase edge interrupt of a crankshaft encoder wheel as a signal with high chronological resolution to the control device, with the result that the control device can determine the rotational speed gradient on the basis of this signal with high chronological resolution.

Subsequently, in a step S5 the pulse duty factor is corrected as a function of the rotational speed gradient in such a way that the influence of the reversal C of the direction of rotation on the position of the camshaft G can be compensated. It is particularly advantageous here if the influence of the reversal C of the direction of rotation on the pulse duty factor B is stored as a function of the rotational speed gradient as a characteristic diagram in the control device, and the values of the characteristic diagram are added to the pulse duty factor B during the compensation of the reversal C of the direction of rotation.

FIG. 2 shows a schematic graphic illustration of a profile of the position of the camshaft G as a function of the time after the outputting of a stop request A with a compensation B according to the method described above. After the outputting of the stop request A, the rotational speed n is reduced and a pulse duty factor B, which is intended to counteract a camshaft torque, is output. If a reversal of the direction of rotation is detected, as illustrated in the regions C, an intensity level D1 and D2 of this reversal of the direction of rotation is calculated by determining the rotational speed gradient. The pulse duty factor B is corrected as a function of the calculated rotational speed gradient in such a way that the influence of the reversal C of the direction of rotation on the position of the camshaft G is largely compensated, with the result that a virtually ideal starting position of the camshaft can be achieved, as a result of which optimum combustion and therefore the duration of the cold starting process can be shortened.

FIG. 3 illustrates, in contrast to FIG. 2, a method according to the previous prior art. It is clearly apparent here that the pulse duty factor B' which is output assumes a continuous profile, and therefore it cannot counteract the reversal C' of the direction of rotation and the intensity level D1' and D2' of the reversal C' of the direction of rotation of the camshaft. Correspondingly, the position of the camshaft G' is adjusted in an uncontrolled and undesired fashion.

The invention is not restricted to the exemplary embodiment described but rather also comprises other identically acting embodiments. The description of the figures serves merely to promote comprehension of the invention.

The invention claimed is:

1. A method for controlling an internal combustion engine having a camshaft whose phase with respect to a crankshaft can be adjusted by means of an electric adjustment device, and a control device, the method comprising:

S1 outputting a stop request from the control device to the electric adjustment device;

S2 outputting a manipulated variable in the form of a pulse duty factor from the electric adjustment device, wherein the pulse duty factor counteracts a camshaft torque; and S3 monitoring the direction of rotation of the camshaft: wherein S4 when a reversal of the direction of rotation of the camshaft is detected, an intensity level of this reversal of the direction of rotation is calculated by determining a rotational speed gradient; and wherein S5 furthermore, the pulse duty factor is corrected as a function of the rotational speed gradient in such a way that the influence of the reversal of the direction of rotation on the position of the camshaft is compensated, wherein the influence of the reversal of the direction of rotation on the pulse duty factor is stored as a function of the rotational speed gradient as a characteristic diagram in the control device, wherein values of the characteristic diagram are added to the pulse duty factor during the compensation of the reversal of the direction of rotation.

2. The method as claimed in claim 1, wherein the detection of the reversal of the direction of rotation takes place by means of a sensor and/or by means of a functional solution in the control device.

3. The method as claimed in claim 2, wherein the outputting of a correction signal is carried out by the control device.

4. The method as claimed in claim 3, wherein the internal combustion engine comprises a camshaft sensor which is connected to the control device, wherein the camshaft sensor transmits a phase edge interrupt of a crankshaft encoder wheel as a signal with high chronological resolution to the control device.

5. The method as claimed in claim 4, wherein the control device carries out the determination of the rotational speed gradient on the basis of this signal with high chronological resolution.

6. The method as claimed in claim 1, wherein the camshaft sensor is integrated into the sensor for detecting the reversal of the direction of rotation, or vice versa.

7. The method as claimed in claim 1, wherein the detection of the reversal of the direction of rotation is carried out by the control device.

8. A camshaft adjustment device for an internal combustion engine having a camshaft and a crankshaft, comprising a control device and at least one sensor, wherein the sensor is configured to provide the control device with information about the direction of rotation of the camshaft, characterized in that the control device is configured to carry out a method comprising:

S1 outputting a stop request from the control device to the electric adjustment device;

S2 outputting a manipulated variable in the form of a pulse duty factor from the electric adjustment device, wherein the pulse duty factor counteracts a camshaft torque; and S3 monitoring the direction of rotation of the camshaft: wherein S4 when a reversal of the direction of rotation of the camshaft is detected, an intensity level of this reversal of the direction of rotation is calculated by determining a rotational speed gradient; and wherein S5 furthermore, the pulse duty factor is corrected as a function of the rotational speed gradient in such a way that the influence of the reversal of the direction of rotation on the position of the camshaft is compensated, wherein the influence of the reversal of the direction of rotation on the pulse duty factor is stored as a function of the rotational speed gradient as a characteristic diagram in the control device, wherein values of the characteristic diagram are added to the pulse duty factor during the compensation of the reversal of the direction of rotation.

9. The camshaft adjustment device as claimed in claim 8, wherein the camshaft adjustment device comprises a camshaft sensor which is connected to the control device, wherein the camshaft sensor transmits a phase edge interrupt of a crankshaft encoder wheel as a signal with high chronological resolution to the control device.

10. The camshaft adjustment device as claimed in claim 9, wherein the reversal of the direction of rotation is detected by means of a sensor and/or by means of a functional solution in the control device.

11. The camshaft adjustment device as claimed in claim 10, wherein the camshaft sensor is integrated into the sensor for detecting the reversal of the direction of rotation, or vice versa.

12. The camshaft adjustment device as claimed in claim 8, wherein the camshaft sensor is integrated into the sensor for detecting the reversal of the direction of rotation, or vice versa.

13. The camshaft adjustment device as claimed in claim 8, wherein the detection of the reversal of the direction of rotation is carried out by the control device.

14. A motor vehicle having an internal combustion engine having a control device and a camshaft adjustment device, characterized in that the control device is configured to carry out a method comprising:

S1 outputting a stop request from the control device to the electric adjustment device;

S2 outputting a manipulated variable in the form of a pulse duty factor from the electric adjustment device, wherein the pulse duty factor counteracts a camshaft torque; and S3 monitoring the direction of rotation of the camshaft: wherein S4 when a reversal of the direction of rotation of the camshaft is detected, an intensity level of this reversal of the direction of rotation is calculated by determining a rotational speed gradient; and wherein S5 furthermore, the pulse duty factor is corrected as a function of the rotational speed gradient in such a way that the influence of the reversal of the direction of rotation on the position of the camshaft is compensated, wherein the influence of the reversal of the direction of rotation on the pulse duty factor is stored as a function of the rotational speed gradient as a characteristic diagram in the control device, wherein values of the characteristic diagram are added to the pulse duty factor during the compensation of the reversal of the direction of rotation.

15. The motor vehicle as claimed in claim 14, wherein the camshaft adjustment device comprises a camshaft sensor which is connected to the control device, wherein the camshaft sensor transmits a phase edge interrupt of a crankshaft encoder wheel as a signal with high chronological resolution to the control device.

16. The motor vehicle as claimed in claim 15, wherein detection of the reversal of the direction of rotation takes place by means of a sensor and/or by means of a functional solution in the control device.

17. The motor vehicle as claimed in claim 16, wherein the camshaft sensor is integrated into the sensor for detecting the reversal of the direction of rotation, or vice versa.

18. The motor vehicle as claimed in claim 14, wherein the camshaft sensor is integrated into the sensor for detecting the reversal of the direction of rotation, or vice versa.

* * * * *